United States Patent [19]

Sochor

[11] Patent Number: 4,619,495

[45] Date of Patent: Oct. 28, 1986

[54] HIGH-DENSITY PRESS-FIT CARDEDGE CONNECTORS

[76] Inventor: Jerzy R. Sochor, 164 Rockview, Irvine, Calif. 92715

[21] Appl. No.: 641,940

[22] Filed: Aug. 17, 1984

Related U.S. Application Data

[63] Continuation of Ser. No. 415,140, Sep. 7, 1982, abandoned.

[51] Int. Cl.[4] ..... H01R 9/09; H01R 13/05

[52] U.S. Cl. ..... 339/176 MP; 339/221 M

[58] Field of Search ..... 339/17 C, 176 MP, 220 R, 339/221 R, 221 M

[56] References Cited

U.S. PATENT DOCUMENTS

| | | | |
|---|---|---|---|
| 3,231,848 | 1/1966 | Ruehlemann | 339/176 MP |
| 3,530,422 | 9/1970 | Goodman | 339/176 MP |
| 3,685,001 | 8/1972 | Krafthefer | 339/217 S |
| 3,903,458 | 9/1975 | Arnoux | 339/176 MP |
| 4,275,944 | 6/1981 | Sochor | 339/176 MP |
| 4,286,837 | 9/1981 | Yasutake et al. | 339/221 R |
| 4,525,015 | 6/1985 | Schwindt | 339/17 C |

FOREIGN PATENT DOCUMENTS

| | | | |
|---|---|---|---|
| 1108257 | 9/1981 | Canada | 339/176 MP |
| 1399216 | 4/1965 | France | 339/220 R |

OTHER PUBLICATIONS

"Breaking 50 Mil Barrier with Component Interchangeable Edge-Mount Connector System", by Jerry Sochor, Elco Corp., Oct. 19-20, 1977, pp. 183, 184, 186-194.

*Primary Examiner*—Gil Weidenfeld
*Assistant Examiner*—Gary F. Paumen
*Attorney, Agent, or Firm*—David Pressman

[57] ABSTRACT

A versatile cardedge receptacle comprises an insulative housing (10) having contacts (16,18) with one or more cantilevered contact beams (20) and one or more cantilevered parallel retention arms (22) and/or lateral shoulders (36,38) with bearing surfaces (50,52) for application of seating force necessary to press-fit install a discrete (preassembled) receptacle into a wiring panel (72) in a single step. The bearing surfaces (50,52) are positioned colinearly with their respective press-fit terminals (26,28), and can be accessed by the seating tool (56), either internally through the card slot (12) or externally from the sides (62) of the housing. The undersides of contact shoulders (36,38) can be used to facilitate forcible extraction of the entire connector from the wiring panel (72) with a footed tool (77).

8 Claims, 8 Drawing Figures

HIGH-DENSITY PRESS-FIT CARDEDGE CONNECTORS

This is a continuation of Ser. No. 415,140, filed Sept. 7, 1982, now abandoned.

FIELD OF INVENTION

This invention relates generally to cardedge electrical connectors and particularily to such a connector with a high density array of contacts which can be press-fit mounted in a wiring panel.

DESCRIPTION OF PRIOR ART

Mounting of connector receptacles on wiring panels was originally accomplished by soldering. As is well known, this method required expensive mass soldering equipment, necessitated careful control of many critical process variables to assure reliability, subjected the circuitry and solder joints to thermal shock, and resulted in poor repairability.

Press-fitting was another established technology, in which contact terminals were installed by interference fit in plated-through holes in a circuit board. In the traditional press-fit approach, developed in early 1960's for wire-wrapping applications, the contacts were installed first, while still on a carrier strip. Then the carrier portion of such strip was broken off and the insulator housing was assembled over the individually mounted contacts. Since connector component parts had to be handled separately by means of special tools in such a press-fit installation, the operation generally could be performed only by connector manufacturers and a few specially-equipped major users. Because the insulator was installed in a separate step, after the press-fit installation of contacts in the wiring panel, it could not serve as a means of defining and mantaining contact positions. Accordingly, the contacts had to be inserted in the wiring panel very precisely to assure accurate positioning and proper insulator retention. For example, even a relatively small deviation of a contact's vertical position would significantly affect the gap dimension between opposing contact noses, causing marginal contact forces or costly rework. The positions of contact noses could be further aggravated by an excessive interference between the insulator and the contact, which can also cause overstress cracking of the insulator. On the other hand, the contact positions were sometimes such that the insulator was not always positively retained, whereby it could separate from contacts in use and handling, especially after repeated removal for contact replacement.

The difficulties associated with the above-mentioned press-fit assembly method led to another press-fit approach whereby a completely assembled (discrete) connector was installed in a wiring panel in a single step. The connector was seated in a wiring panel by force-fit using a relatively sophisticated seating tool. The tool exerted the seating force necessary to effect the interference fit by pressing against specially-formed shoulders on the contacts, located within or on the sides of the connector. The additional forming operation required to provide the contact shoulders made contacts more difficult to fabricate and not amenable to further miniaturization. The shoulders or bearing surfaces were usually offset formed and thus could not be positioned colinearly with the press-fit tails. Also, the bearing surfaces were not easily accessible to the seating tool.

The force required to install a single contact could be as high as 22.7 kG (50 pounds) and thus the seating force had to be applied as directly over the terminal as possible, and preferably axially with the terminal. This force was impractically high for a high-contact-count connector. To avoid these problems, tails with compliant sections were often used. In addition to substantially reducing the seating force through controllable yielding, a compliant terminal provided greater spring pressure reserve at the interface of terminal and plated-through hole and also lowered the stresses in the wiring panel. However, these terminals were usually oriented with their wider dimension along the connector's length, which increased the nominal press-fit interference by the cummulative true position tolerance mismatch between the terminals and their respective plated-through holes. This tolerance build-up was greater in the longitudinal direction, within the terminal rows, than in the lateral direction, which is only affected by a non-cummulative tolerance on the spacing between the terminal rows.

As the result of the foregoing disadvantages, presently used connectors for press-fit mounting have not been able to provide contact spacing of less than 2.54 mm (0.100″), with the press-fit terminals arranged in more than two rows. Higher contact density connectors (e.g., with 1.27 mm or 0.050″ spacing) were not feasible since such connectors would require four rows of terminals to provide a 2.54 mm (0.100″) tail grid; this is desirable for automatic wire-wrapping.

The press-fit connectors most commonly have long post terminals for wire-wrapping or mating with input-output cable connectors. However, the press-fit approach is also preferable in short tail applications where all backpanel interconnections are made by printed wiring to assure signal integrity, and where a high etched trace density and/or susceptability to thermal shock make conventional soldering undesirable. Instead, heretofore soldering was often used in these applications because of unavailability of low cost, easily installable discrete press-fit connectors.

OBJECTS OF THE INVENTION

Accordingly, one object of this invention is to provide discrete press-fit connectors with closer contact spacing then heretofore attainable. In accordance with this invention, connectors with 1.27 mm (0.050″) spacing can be easily and inexpensively constructed without sacrificing the contact spring parameters of presently used standard spacing connectors. Other objects are to provide an arrangement for press-fit installation of high density connectors with four rows of terminals, to provide discrete press-fit connectors with press-fit terminals which are arranged in a way which minimizes the added installation interference caused by cummulative positional tolerances, to provide means of application of positive seating pressure colinearly with the press-fit terminals using a simple seating tool, to facilitate servicing of discrete press-fit connectors by providing a means of connector removal from the wiring panel in a simple, single step, and the provision of novel discrete press-fit Zero Insertion Force (ZIF) connectors and self-retaining compliant pin connectors for soldering applications.

The present invention thus provides improved connectors for press-fit and soldering applications, and methods for force-fit installation thereof in wiring panels. This method enables the construction of high contact density press-fit connectors, greatly simplifies their installation and lowers the total installed cost.

Figure 2:
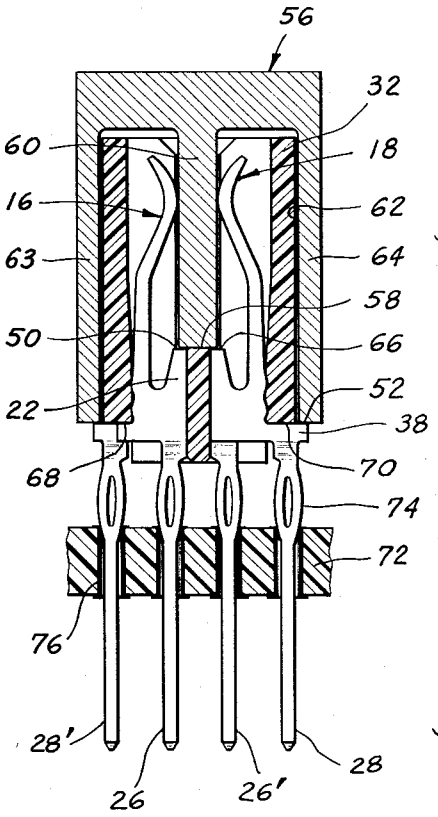
FIG. 2 is a sectional end view of the connector from FIG. 1, shown with the seating tool to illustrate the press-fit installation principle.

| Reference Numerals | |
|---|---|
| 10 insulator | 72 wiring panel |
| 12 slot | 74 compliant section |
| 14 contact recess | 76 plated-through hole |
| 16 contact | 78 plate |
| 18 contact | 80 projection |
| 20 contact beam | 82 projection |
| 22 parallel arm | 84 insulator |
| 24 body portion | 86 opening |
| 26 tail | 88 undercut |
| 28 tail | 90 bearing surface |
| 30 barbs | 92 terminal |
| 32 wall | 94 bearing surface |
| 34 dividing wall | 96 terminal |
| 36 lateral shoulder | 98 contact |
| 38 lateral shoulder | 100 insulator apperture |
| 40 partition wall | 102 insulator |
| 42 offset | 104 shoulder |
| 44 offset | 106 retention arm |
| 46 contact nose | 108 dividing wall |
| 48 post | 110 contact beam |
| 50 arm surface | 112 body underside |
| 52 shoulder surface | 114 contact |
| 54 press-fit section | 116 contact |
| 56 seating tool | 118 terminal |
| 58 bottom of slot | 120 terminal |
| 60 center wall | 122 contact beam |
| 62 insulator side | 124 bearing surface |
| 63 side wall | 126 bearing surface |
| 64 side wall | 128 compliant section |
| 66 secondary support | 130 insulator |
| 68 secondary support | 132 support surface |
| 70 secondary support | 134 support surface |
| 105 bridging member | 136 shoulder |

Figure 1:
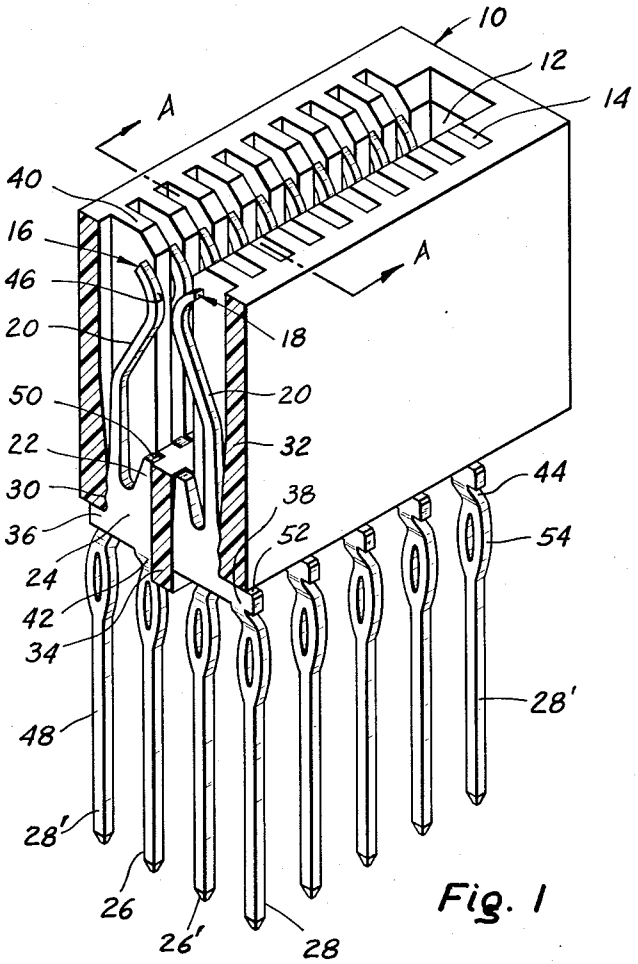
FIG. 1 shows a sectional isometric view of a high density edgeboard connector with the pair of contacts alternately rotated 180° to form four rows of terminals.

FIG. 1—Isometric View of Edgeboard Connector

The connector of a preferred embodiment of the invention, shown in FIG. 1, comprises an insulator housing 10 and two types of contacts 16, 18 arranged in a repeating, alternating pattern. Contacts 16 and 18 are substantially similar, except their tails have different lateral positions so that a connector with four rows of contacts can be obtained.

Insulator 10 comprises an elongated strip of plastic material, such as nylon or diallyl phthalate, having a slot 12 along the length thereof with contact receiving recesses 14 communicating with but oriented at right angles to, slot 12.

Each of the two opposing contacts 16 and 18 has an identical contact beam 20, a parallel retention arm 22, and a body portion 24, but their respective tails 26 and 28 occupy laterally different positions with respect to the above features. Tail 26 of contact 16 is positioned directly below parallel retention arm 22, while tail 28 of contact 18 is spaced from retention arm 22 by a distance equal to the desired spacing between the contact terminal rows.

Each contact is installed (loaded) by force fit into a respective recess of insulator 10 from the bottom side and retained by engagement of barbs 30 with insulator wall 32, and by interference friction between the outside edge of retention arm 22 and dividing wall 34. Lateral shoulders 36 and 38 provide a positive locating function which prevents contact overinsertion into recess 14, and later also prevents undesirable contact movement due to press-fit installation as well as pushout force and torque imposed by the wire-wrapping tool.

Body portion 24 of each contact is further closely confined by partition walls 40 in order to stabilize the contact in the transverse direction. Contact recess 14 may have a substantially uniform width in the vertical direction, in which case the contact thickness above the body portion 24 can be slightly reduced to assure adequate operating clearance for the contact beam. Such reduction in thickness can be achieved by coining the contact blank in a stamping die or using a variable thickness stock. Alternatively, a uniform thickness contact can be used with partition wall 40 stepped down in thickness above contact body portion 24 to provide the operating clearance.

FIG. 2—Sectional End View of FIG. 1 Connector

FIG. 2 is a cross-sectional view of the connector of FIG. 1 taken at A—A, or at any even-numbered contact recess counted therefrom. FIG. 2 further shows the seating tool in order to illustrate the principle of the connector installation into a wiring panel.

Seating tool 56 comprises an elongated member having three downward walls 60, 63, and 64. It is shown in contact with primary bearing surfaces 50 and 52, on contacts 16 and 18, respectively, through which the installation pressure is transmitted to terminals 26 and 28 directly underneath.

Bearing surface 50 for contact 16, (and also the similarily-located bearing surfaces for the other contacts forming the two inner rows of terminals) is level with, or slightly elevated above, the bottom 58 of slot 12, so that it can be accessed by center wall 60 of tool 56, when it is inserted into slot 12. Note that bearing surface 50 is a "primary" bearing surface for contact 16 since it is coaxial with the tail of this contact.

Bearing surface 52 for contact 18 (and also the similarily-located bearing surfaces for the other contacts forming the two outer rows of terminals) protrudes laterally beyond insulator side 62, and is accessed by side walls 63 and 64 of tool 56. Bearing surface 52 is a primary bearing surface for contact 18, since it is coaxial with the tail of this contact.

This arrangement results in the application of the seating pressure coaxially with the terminals, thus assuring positive and direct pressure without undesirable lateral contact movement.

In addition, the contacts with the outer terminals have secondary bearing surfaces in contact with the seating tool, as at 66, and with the bottom of the insulator wall 32, as at 70. Similarily, the contacts with the inner terminals have secondary bearing surfaces with the bottom of insulator wall, as at 68, for further stabilization.

The press-fit installation of the discrete connector into a wiring panel 72 is accomplished by forcing, by means of downward movement of tool 56, all four rows of compliant press-fit sections 74 into respective plated-through holes 76.

When pressed into plated-through holes, cbmpliant sections 74 deform controllably, thus complying with the plated-through holes which are only slightly deformed in the process. In contrast, when non-compliant, or solid press-fit sections are inserted, only the hole is deformed, often assuming a characteristic rectangular shape. Part of the deformation of the compliant section 74 is elastic; thus such sections provide spring pressure reserve at the interface of the terminal and the plated-through hole. Such elastic pressure reserve aids in mantaining a gas-tight connection in long term operation and adverse environments. Excessive press-fit installation stresses, as well as related warpage of the wiring panels, are substantially eliminated since these stresses are limited by the pressure that can be sustained by the yielding compliant section.

Each pair of opposing contacts 16 and 18 is installed in the insulator rotated 180° relative to the preceeding pair, so that each two adjacent contact pairs provide terminals at four laterally spaced locations. When this alternating pattern is repeated, a connector with four rows of terminals is obtained. Contact tails 26 and 28 are offset, at 42 and 44, respectively, from their body portions, by a distance equal to one-half of the contact pitch at the edgeboard interface, so that the four tails from two adjacent contact pairs are lined-up in the lateral direction. For example, if the contact noses 46 are on 1.27 mm (0.050") pitch, the tails are offset by 0.64 mm (0.025"), so that the four rows of terminals form a 2.54 mm (0.100") square grid, suitable for automatic wire wrapping of posts 48. Only the four tails contributed by the first two pairs of contacts are fully depicted for clarity of illustration.

It is seen that top surface 50 of retention arm 22, as well as top surface 52 of laterally protruding shoulder 38, serves as a bearing surface for forcible installation of compliant press-fit sections 54 (located directly underneath) into a wiring panel in a single step operation.

Figure 3:
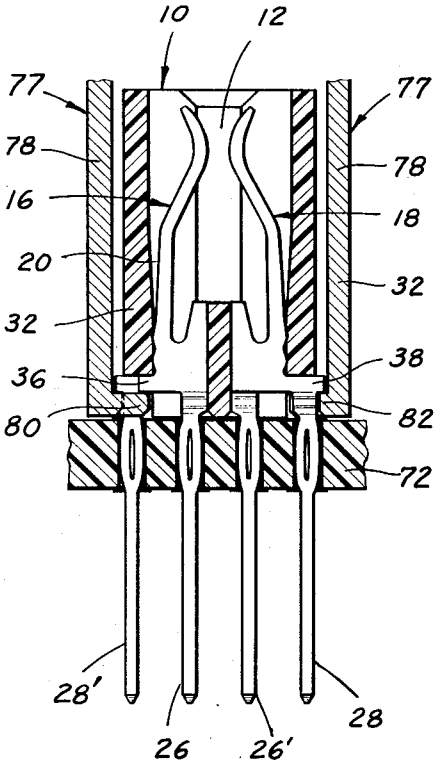
FIG. 3 illustrates the method of service related removal of the connector of FIG. 1 from a wiring panel.

FIG. 3—Sectional View of Installed Connector of FIG. 1

FIG. 3 is a cross-sectional view of the connector seen in the preceeding figures, after installation in wiring panel 72. The entire connector can be extracted from a wiring panel by simultaneously engaging the undersides of lateral shoulders 36 and 38 of all contacts. Extraction tool 77, which is shown in fragmentary form, facilitates such extraction of the entire connector from wiring panel 72 in a single step operation.

Two footed plates 78 of extraction tool 77 have alternating projections 80 and 82 which extend toward and engage the undersides of respective contact shoulders 36 and 38. In each pair of opposing contacts, such as 16 and 18, the longer projection engages the underside of shoulder 36, while on the opposite side, the shorter projection engages the underside of shoulder 38. The engagement can be effected by camming, or pivotally rotating plates 78. After engagement of alternating projections 80 and 82 under the contact shoulders, tool 77 is lifted upwardly, pulling the entire connector out of panel 72.

Figure 4:
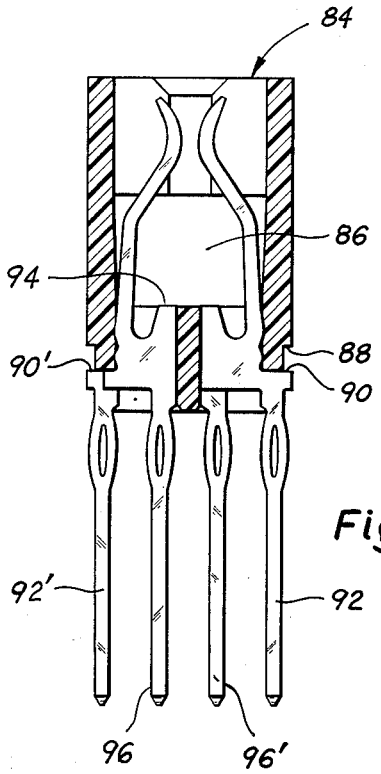
FIG. 4 is a cross-sectional view of the connector of FIG. 1, with a provision for accommodating a ZIF actuating mechanism.

FIG. 4—Sectional View of ZIF Embodiment

The connector of FIG. 4 is similar to that of FIG. 1, but it has a provision for accommodating a ZIF actuating mechanism. The ZIF mechanism is inserted in relief opening 86 between contact beams. It is used to spread the contact beams, permitting insertion of a printed circuit board without encountering the contact noses, and then release the contact beams allowing them to make pressure connections with the circuit traces on the board. Such a ZIF feature is especially desirable in the high density, high contact count connectors which can be constructed according to the present invention. The actuating mechanism is not shown, since numerous actuating mechanisms, such as a rotating cam or a draw bar shown in my U.S. Pat. No. 4,275,944, granted 1981-06-30, can be employed.

Insulator 84 is made wider than insulator 10 of FIG. 1 in order to maximize the size of relief opening 86, so that a sufficiently sturdy actuating mechanism can be employed.

Prior to insertion of a ZIF actuating mechanism in opening 86, the connector may be press-fit installed in a wiring panel in a manner similar to that described in connection with FIG. 2. Insulator undercuts 88 allow the seating tool access to bearing surfaces 90, through which the seating pressure is transmitted to the two outside rows of terminals 92. Bearing surfaces 94 are used to transmit the seating pressure to the two centrally disposed rows of terminals 96. These surfaces are level with, or slightly above, the bottom of relief opening 86, and can be accessed via the card slot, using the tool's center bar, as shown in FIG. 2.

FIG. 5—Sectional View of Connector With Top Removable Contacts

Figure 5A:
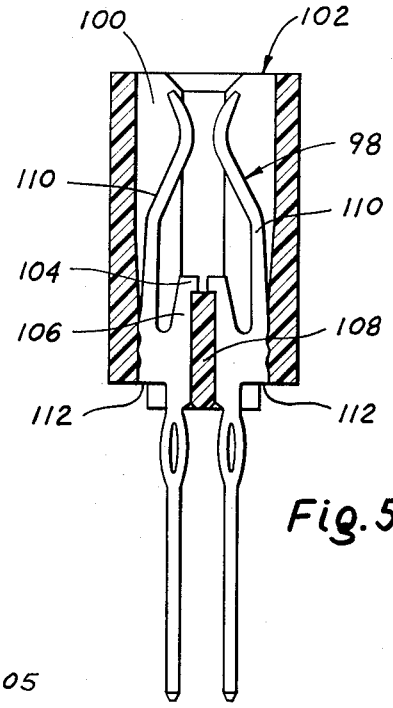
FIGS. 5*a* and 5*b* show cross-sectional views of a press-fit connector with top-removable contacts and with provision for application of the installation force through the card slot.

FIG. 5*a* is a cross-sectional view of a connector with one type of contact 98, arranged in two opposing rows and having two rows of inner (centrally-disposed) tails. The press-fit installation of the connector in a wiring panel is accomplished with a single bar, which accesses all contacts via the card slot.

Contacts 98 are assembled in insulator appertures 100 from the top of insulator 102, until lateral shoulder 104 on the top of retention arm 106 rests against the top surface of dividing wall 108. The shoulders 104 protrude toward the center of the card slot and thus provide an increased bearing surface area for the seating tool.

After installation of the connector in a wiring panel, all contacts 98 collectively hold down insulator 102 through lateral shoulders 104. Conversely, the connector can be extracted from the wiring panel by application of the extraction force directly to the insulator, which in turn removes all the contacts by the virtue of the engagement with lateral shoulders 104. Alternatively, the contacts can be engaged by the extraction tool at contact body undersides 112 in order to facilitate extraction of the entire connector from a wiring panel, in a manner similar to that illustrated in FIG. 3.

The above procedures do not preclude a service necessitated removal and replacement of individual contacts while the connector remains seated on the wiring panel.

Figure 5B:
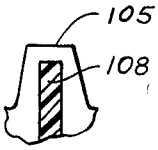

FIG. 5*b* illustrates a fragment of FIG. 5*a* comprising shoulders 104 and the top of dividing wall 108. In the version of FIG. 5*b* a bridging member 105 is provided to join shoulders 104 of opposed contacts, thereby to obtain a contact with an electrically common pair of beams 110, or what is termed a single readout contact.

Figure 6:
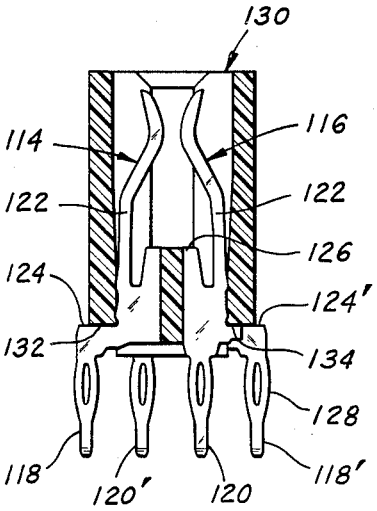
FIG. 6 is a cross-sectional view of a press-fit connector with two rows of press-fit and/or solder terminals.

FIG. 6—Sectional View of Connector With Flat Contacts

FIG. 6 is an end-sectional view of a cardedge press-fit connector with two types of contacts and having four rows of short compliant press-fit terminals. These contacts are stamped as flat blanks, i.e., without forming or coining, and are made from a thinner material than those contacts requiring wire-wrappable posts. Thus, economical connectors can be constructed for efficient installation in wiring panels using press-fit installation, soldering, or a combination thereof.

As in the embodiment of FIG. 1, the pairs of opposing contacts 114 and 116 are assembled alternately rotated 180° to provide four equally spaced rows of tails 118 and 120. The tails are coplanar with contact beams 122, so that the tails from the consecutive pairs of contacts are spaced by the distance equal to the contact pitch along the cardedge interface, resulting in a staggered tail grid. For example, if the contact pitch is 1.27 mm (0.050″), the terminal spacing within each row will be 2.54 mm (0.100″), and the adjacent rows of terminals will be shifted, or staggered, by 1.27 mm (0.050″) in the longitudinal direction of the connector.

Installation of the connector in a wiring panel is accomplished with a seating tool similar to that in FIG. 2; this accesses contact bearing surfaces 124 and 126, which is positioned axially with their respective terminals 118 and 120.

For soldering applications, a slightly larger panel hole can be specified, to create a lighter interference fit with compliant section 128. The lower installation force thus obtained permits using insulator 130, rather than the seating tool, to transfer the seating force to the terminals via support surfaces 132 and 134. When installed in a wiring panel, the connector retains itself for the subsequent soldering operation, thus eliminating external hold-down devices. Since the compliant sections are in intimate contact with the plated through holes, they can be pre-plated with solder and, after press-fit installation, heated to fuse, or reflow solder, the interface. Reflow-soldering may be preferable in cases where external application of solder is difficult to control, and/or could produce bridging of closely spaced wiring traces.

Figure 7:
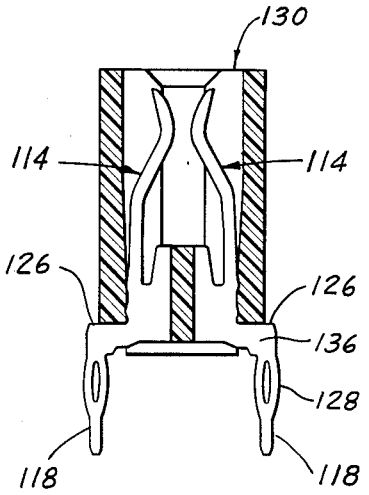
FIG. 7 is a cross-sectional view of a press-fit connector with two rows of press-fit and/or solder terminals and a provision for external application of the installation force on the sides of the connector.

FIG. 7—Sectional View of Connector With Outerly Disposed Tails

The connector represented by the end-sectional view of FIG. 7 has only one contact type, such as contact 114 from the preceeding figure.

Contact terminals 118, with shoulders 136, protrude laterally beyond the confines of the insulator to permit an easy access by a seating tool similar to that of FIG. 2, but with the center bar omitted.

Shoulders 136 can also be accessed by an induction heating element to permit reflow soldering operation with localized heat.

While the invention has been described specifically, it will be appreciated that many variations are possible within the scope of the invention. For example, many other dimensions, and contact and insulator shapes are possible. These include two piece connectors, with seating tool access through mating blade entry openings, single read-out connectors, and connectors with preloaded contact beams. Certain features can be replaced with functional equivalents; for example contact parallel retention arms could be omitted and instead larger contact body portions could be used, extending to the bottom of the card slot, to provide sufficient retention engagement and installation force bearing surfaces. Also, the features of the various embodiments can be combined to produce arrangements other than those indicated. Accordingly, the scope of the invention should be determined not by the embodiments illustrated, but by the appended claims and their legal equivalents.

I claim:

1. A cardedge connector having extremely-high-density contacts and capable of being reliably press-fit mounted in a wiring panel, comprising:

(a) an insulator housing having two rows of conductive contacts mounted within said housing, (b) said housing comprising an insulating member having oppositely-facing upper and lower surfaces, oppositely-facing side surfaces, and oppositely-facing end surfaces, said upper surface having an elongated opening therein parallel to said side surfaces, said housing having two parallel side walls whose outer surfaces comprise said oppositely-facing side surfaces, each of said side walls having a downwardly-facing bottom surface, (c) said elongated opening in said upper surface of said insulator housing extending into the body of said housing to form a slot separating said side walls, said slot having a predetermined length and width for receiving the edge of a circuit board of a predetermined width and thickness, said slot communicating with individual contact recesses extending from said slot toward and perpendicular to said side surfaces, (d) said contacts each being elongated, vertically-oriented, and each mounted in a respective one of said recesses within said insulator housing by force fit, (e) each contact having in the middle thereof a body portion containing means for retaining said body portion in a lower part of said insulator housing, (f) each contact also having an upper portion comprising a cantilevered mating arm extending up from said body portion toward said upper surface, (g) said mating arm having a convex mating surface adjacent the free end of said mating arm, said mating surface extending into said slot when said mating arm is in its free state so as to be positioned to mate with a printed circuit board when it is inserted into said slot, (h) each contact also having a lower portion comprising a tail section extending down and out from the bottom surface of said housing, said tail section having means for interference retention in a hole of a predetermined size in a wiring panel when said tail section is pressed into said hole, thereby also to retain and electrically connect said connector to said wiring panel when its contact tails are pressed into respective holes in said wiring panel, (i) the tail sections of the contacts in each row of contacts being arranged in two subrows, one subrow of tail sections being an outer subrow and one being an inner subrow, such that said connector has four subrows of tail sections extending downwardly therefrom, said four subrows of tail sections comprising two outer subrows and two inner subrows, alternating contacts in each row of contacts having tail sections in said outer and said inner subrows, respectively, such that every other contact in each row of contacts has a tail section in an outer subrow and the rest of the contacts in each row have contacts tail sections in an inner subrow, the tail sections in said outer subrow being at least partially aligned vertically with a respective sidewall of said insulator housing, (j) each contact also having a cantilevered installation arm extending upward from its body portion, said arm having an upper end which forms an inner bearing surface extending into said slot, said inner bearing surface being straight and facing upwardly and parallel to said upper surface of said insulator housing, (k) each contact also having a lateral portion extending laterally in an outward direction parallel to said upper surface of said insulator housing from said body portion of said contact, said lateral portion having a straight, upwardly-facing bearing surface which is parallel to said upper surface of said insulator housing, said upwardly-facing surface of said lateral portion contacting said downwardly-facing bottom surface of one of said side walls of said insulator housing, whereby when said insulator housing is pressed downwardly it will bear against said lateral portions of said contacts so as to apply balanced pressure to said contacts during insertion, (l) each contact which has a tail section in said inner subrows having its tail section in vertical alignment with the cantilevered installation arm of such contact, (m) the lateral sections of said contacts which have tail sections in said outer subrow extending under and out beyond their respective side wall of said insulator housing, said outer subrow tail sections being aligned under the outer bearing surfaces of said lateral portions, (n) each contact shaped to be insertable into and withdrawable from said insulator housing from the bottom thereof only, (o) whereby a seating tool having three parallel walls can be used to press said connector into said wiring panel by simultaneously (1) using the two outer walls thereof to straddle said connector and apply downward force directly to said lateral sections of said contacts which have tail sections in said outer subrow, such that said tail sections in said outer subrow can be forced directly into their respective holes in said wiring panel with reduced stress and more stability, and (2) inserting the center wall of said seating tool into said slot, such that said center wall will contact said inner bearing surfaces of said contacts and force said upwardly-facing bearing surfaces of said contacts, directly and via said housing, and hence said tail sections of said contacts which have their tail sections in said inner subrow, into their respective holes in said wiring panel with reduced stress and more stability.

2. The connector of claim 1 wherein said side walls of said insulator housing are undercut so as to be higher than the rest of the bottom of said housing so as to permit removal of said connector from a wiring panel with a footed extraction tool.

3. The connector of claim 1 wherein said lateral portion of each of said contacts has a downwardly-facing surface which is spaced upwardly from the bottom of said insulator housing so as to be accessible by a footed extraction tool for ease of removal of said connector from said wiring panel.

4. The connector of claim 1 further including means for receiving a zero-insertion-force actuating mechanism which can spread said mating surfaces further apart than they are when in their rest positions.

5. The connector of claim 1 wherein each of said tail sections has a laterally-compliant section, whereby each tail section can fit into a hole in said wiring panel with reduced effort.

6. The connector of claim 1, further including said seating tool, said seating tool having said three parallel walls, said three walls comprising an inner wall dimensioned to fit into said slot in said insulator housing and apply force to said upwardly-facing bearing surfaces, and said two outer walls sandwiching said inner wall and dimensioned to straddly said insulator housing and apply insertion force to said outwardly-extending lateral portions.

7. A cardedge connector having extremely-high-density contacts and capable of being reliably press-fit mounted in a wiring panel, comprising:

(a) an insulator housing and a plurality of conductive contacts mounted within said housing, (b) said housing comprising a member having oppositely-facing upper and lower surfaces, oppositely-facing side surfaces, and oppositely-facing end surfaces, said upper surface having an elongated opening therein parallel to said side surfaces, said housing having two parallel side walls whose outer surfaces comprise said oppositely-facing side surfaces, each of said side walls having a downwardly-facing bottom surface, (c) said opening extending into the body of said housing to form a slot separating said side walls, said slot having a predetermined size for receiving the edge of a circuit board and communicating with individual contact recesses extending from said opening toward and perpendicular to said side surfaces, (d) said contacts each being elongated, vertically-oriented, and each mounted in a respective one of said recesses within said insulator housing, (e) each contact having in the middle thereof a body portion containing means for retaining said body portion in a lower part of said insulator housing, (f) each contact also having an upper portion comprising a cantilevered mating arm extending up from said body portion toward said upper surface, (g) said mating arm having a convex mating surface adjacent the free end of said mating arm, said mating surface extending into said slot when said mating arm is in its free state so as to be positioned to mate with a printed circuit board when it is inserted into said slot, (h) each contact also having a lower portion comprising a tail section extending down and out from the bottom surface of said housing, said tail section having means for interference retention in a hole of a predetermined size in said wiring panel when said tail section is pressed into said hole, thereby also to retain and electrically connect said connector to said wiring panel when its contact tails are pressed into respective holes in said wiring panel, (i) each of said contacts also having an upwardly-directed cantilevered installation arm extending up from the body portion thereof and having at the free end thereof an inner bearing surface, said bearing surface extending into said slot, being straight, and facing upwardly and parallel to said upper surface of said insulator housing, (j) the body portion of each contact also having a downwardly-facing surface extending out toward a side wall of said housing and being parallel to said upper surface of said insulator housing, said downwardly-facing surface being higher than the lowermost surface of said housing, said side walls of said housing being undercut and shaped to provide access to said downwardly-facing surfaces of said body portions of said contacts by a footed extraction tool, (k) said contacts being positioned in two rows within said housing, the contacts in each row having alternatingly offset tail sections such that said connector has four subrows of tail sections consisting of two outer and two inner subrows, alternating contacts in each row of contacts having tail sections in an outer subrow and the contacts in each row which are intermediate said contacts with tail sections in said outer subrow having tail sections in said inner subrow, the tail sections in said outer row of contacts being at least partially aligned vertically with a respective side wall of said insulator housing, (l) the contacts with tail sections in said outer subrow having a lateral portion extending out from said body portion and beyond their respective side wall of said insulator housing, said lateral portions each having an upwardly-facing bearing surface, the lower surfaces of said lateral portions being said downwardly-facing surfaces of said body portions of said contacts, (m) the contacts with tail sections in said inner subrow having their tail sections directly below said upwardly-facing bearing surfaces of said inner bearing surfaces, respectively, such that force applied to said inner bearing surfaces will apply direct force to said inner subrow of contact tails, (n) each contact shaped to be insertable into and withdrawable from said insulator housing from the bottom thereof only, (o) whereby said bearing surfaces of said contacts can be accessed by a seating tool having three parallel walls so that (1) the inner subrows of said tail sections of said contacts can be easily pressed directly into said wiring panel by the center wall of said tool when said center wall is inserted into said slot, and (2) the two outer walls of said seating tool can be arranged to straddle said housing, thereby to be able to apply direct downward force to said upwardly-facing bearing surfaces of said lateral portions and hence said outer subrows of tail sections.

8. The connector of claim 7, further including said seating tool, said tool having said three walls, said three walls comprising an inner wall dimensioned to fit into said slot in said insulator housing and apply force to said upwardly-facing bearing surfaces, and said two outer walls sandwiching said inner wall and dimensioned to straddle said insulator housing and apply insertion force to said outwardly-extending lateral portions.

* * * * *